US008011142B2

(12) United States Patent
Marioni

(10) Patent No.: US 8,011,142 B2
(45) Date of Patent: Sep. 6, 2011

(54) SLIDING PENDULUM SEISMIC ISOLATOR

(75) Inventor: Agostino Marioni, Milan (IT)

(73) Assignee: Alga S.p.A., Milan (IT)

( * ) Notice: Subject to any disclaimer, the term of this patent is extended or adjusted under 35 U.S.C. 154(b) by 133 days.

(21) Appl. No.: 12/523,428

(22) PCT Filed: Feb. 6, 2007

(86) PCT No.: PCT/IT2007/000076

§ 371 (c)(1),
(2), (4) Date: Jul. 16, 2009

(87) PCT Pub. No.: WO2008/096378

PCT Pub. Date: Aug. 14, 2008

(65) Prior Publication Data

US 2010/0095608 A1 Apr. 22, 2010

(51) Int. Cl.
*E04H 9/02* (2006.01)

(52) U.S. Cl. ..... 52/167.4; 52/167.1; 248/560; 248/636

(58) Field of Classification Search ..... 52/167.1, 52/167.4, 167.9, 167.2, 167.5, 167.6, 167.7, 52/167.8; 248/560, 562, 638, 632, 636, 566, 248/580

See application file for complete search history.

(56) References Cited

U.S. PATENT DOCUMENTS

| | | | | |
|---|---|---|---|---|
| 4,320,549 | A * | 3/1982 | Greb | 14/73.5 |
| 4,644,714 | A * | 2/1987 | Zayas | 52/167.4 |
| 5,867,951 | A * | 2/1999 | Yaguchi et al. | 52/167.4 |
| 6,021,992 | A | 2/2000 | Yen et al. | |
| 6,126,136 | A * | 10/2000 | Yen et al. | 248/560 |
| 6,631,593 | B2 * | 10/2003 | Kim | 52/167.9 |
| 2003/0167707 | A1 | 9/2003 | Tsai | |
| 2004/0045236 | A1 * | 3/2004 | Kim | 52/274 |
| 2006/0174555 | A1 | 8/2006 | Zayas et al. | |
| 2006/0260222 | A1 * | 11/2006 | Lee | 52/167.5 |
| 2007/0125930 | A1 * | 6/2007 | Tsai | 248/580 |
| 2008/0098671 | A1 * | 5/2008 | Tsai | 52/167.6 |
| 2011/0011013 | A1 * | 1/2011 | Kanazawa | 52/167.9 |
| 2011/0016805 | A1 * | 1/2011 | Tsai | 52/167.1 |

FOREIGN PATENT DOCUMENTS

DE 3819591 A1 12/1989

(Continued)

*Primary Examiner* — Brian Glessner
*Assistant Examiner* — Rodney Mintz
(74) *Attorney, Agent, or Firm* — Lucas & Mercanti, LLP

(57) ABSTRACT

A sliding pendulum seismic isolator (1) comprises a lower sliding element (2) provided with a concave surface (2*a*) facing upwards, an upper sliding element (3) provided with a concave surface (3*a*) facing downwards, a first intermediate element (4) and a second intermediate element (5), said intermediate elements (4, 5) being each provided with a convex sliding surface (4*a*, 5*a*) suitable to allow the sliding of the first and second intermediate elements (4, 5) on the concave surfaces (2*a*, 3*a*) of said lower and upper sliding elements (2, 3) respectively. The first intermediate element (4) has a convex spherical surface (4*b*) opposed to its convex sliding surface (4*a*), and the second intermediate element (5) has a flat surface (5*b*) opposed to its convex sliding surface (5*a*). The convex spherical surface (4*b*) and the flat surface (5*b*) are in contact with each other and are suitable to allow a relative rotation substantially without sliding between the intermediate elements (4, 5). The isolator according to the present invention shows a remarkable reduction of the parasitic moment against the rotation, thus improving the dynamic response of the isolating system and reducing the stresses inside the materials and the adjacent structures.

12 Claims, 3 Drawing Sheets

FOREIGN PATENT DOCUMENTS

| | | | | |
|---|---|---|---|---|
| EP | 2208913 | A1 | * | 7/2010 |
| JP | 11303929 | A | | 11/1999 |
| JP | 2009264429 | A | * | 11/2009 |
| WO | WO 2007116257 | A2 | * | 10/2007 |
| WO | WO 2009034585 | A1 | * | 3/2009 |
| WO | WO 2009054339 | A1 | * | 4/2009 |

* cited by examiner

SLIDING PENDULUM SEISMIC ISOLATOR

This application is a 371 of PCT/IT2007/000076 filed on Feb. 6, 2007, the contents of which are incorporated herein by reference.

FIELD OF THE INVENTION

The present invention relates to a seismic isolator and particularly to a seismic isolator of the sliding pendulum type.

BACKGROUND OF THE INVENTION

There is known the seismic isolation technique using sliding pendulum seismic isolators essentially comprising convex supports coupled with concave sliding surfaces. Such isolators are usually arranged between a superstructure such as, for example, a bridge or a building, and its foundations. In case of earthquakes, the isolators allow a movement of the superstructure with respect to the foundations, thus protecting its integrity.

As an effect of the sliding movement of the convex supports on the concave surfaces, the superstructure oscillates increasing and decreasing its potential energy according to the law of motion of the pendulum, whose natural period is defined by the radius of the concave surface. The radius of the concave surfaces is designed in order to optimize the natural period of the pendulum for the reduction of the seismic response of the superstructure. Moreover, a certain amount of energy is dissipated through the friction of the contact material with the concave surface, thus reducing more the seismic response of the superstructure.

An example of such isolators is given in U.S. Pat. No. 4,644,714, in the name of Earthquake Protection Systems Inc., which discloses a sliding pendulum seismic isolator provided with a lower sliding element fixed on a foundation and an upper element fixed to a superstructure. The lower sliding element has a top concave surface on which an intermediate element slides which has a bottom convex surface of a corresponding curvature. The upper portion of this intermediate element is provided with a convex spherical surface coupled with the upper element through a corresponding concave spherical seat. The contact between this convex spherical surface and the corresponding concave spherical seat enables the relative rotation between the upper element and the intermediate element, which is caused by the movement on the lower concave surface.

An improvement over the above-mentioned support is disclosed in patent application US 2006/0174555 also in the name of Earthquake Protection Systems Inc., which describes a sliding pendulum seismic isolator provided with a lower sliding element and an upper sliding element between which three intermediate elements are arranged that are capable of carrying out relative rotations during the movements of the lower and the upper portions caused by an earthquake. Thanks to this arrangement, the main concave surface described in U.S. Pat. No. 4,644,714 is divided into two concave surfaces, a lower one and an upper one, resulting in a great reduction, for the same horizontal movement, of the floor dimensions of the isolator.

However, the friction caused by the contact and the sliding movement of the intermediate elements with respect to each other causes significant problems to the isolator, which exhibits such parasitic moments against the rotation that they penalize its dynamic response.

Moreover, friction causes significant wear problems to the components of known isolators, which results in complex lubrication systems and in a rather limited service life of the isolators.

Therefore, the object of the present invention is to provide a sliding pendulum seismic isolator capable of overcoming such drawbacks.

SUMMARY OF THE INVENTION

The sliding pendulum seismic isolator according to the present invention comprises a lower sliding element and an upper sliding element with opposed concave surfaces between which there are arranged two intermediate elements slidable along the concave surfaces of the lower and upper sliding elements and coupled to each other through a contact between a spherical-surface and a plane. Therefore, the relative rotation between the intermediate elements occurs through rolling of a sphere on a plane and not through sliding, thus remarkably reducing the parasitic moment against the rotation.

An advantage of the isolator according to the present invention is that, due to the rolling relative movement between the intermediate elements, it improves the dynamic response of the isolating system and reduces the stresses inside the materials and the adjacent structures.

Moreover, it is possible to greatly reduce the thicknesses of the isolator during the design step, thus achieving an isolating device more compact and easy to install.

A further advantage is that the isolator according to the present invention is provided with a simplified structure with respect to known isolators, resulting in a dramatic reduction of the manufacturing costs.

BRIEF DESCRIPTION OF THE DRAWINGS

These and other advantages of the sliding pendulum seismic isolator according to the present invention will be evident to one skilled in the art from the following detailed description of an embodiment thereof with reference to the annexed drawings, wherein.

DETAILED DESCRIPTION OF THE INVENTION

Figure 1:
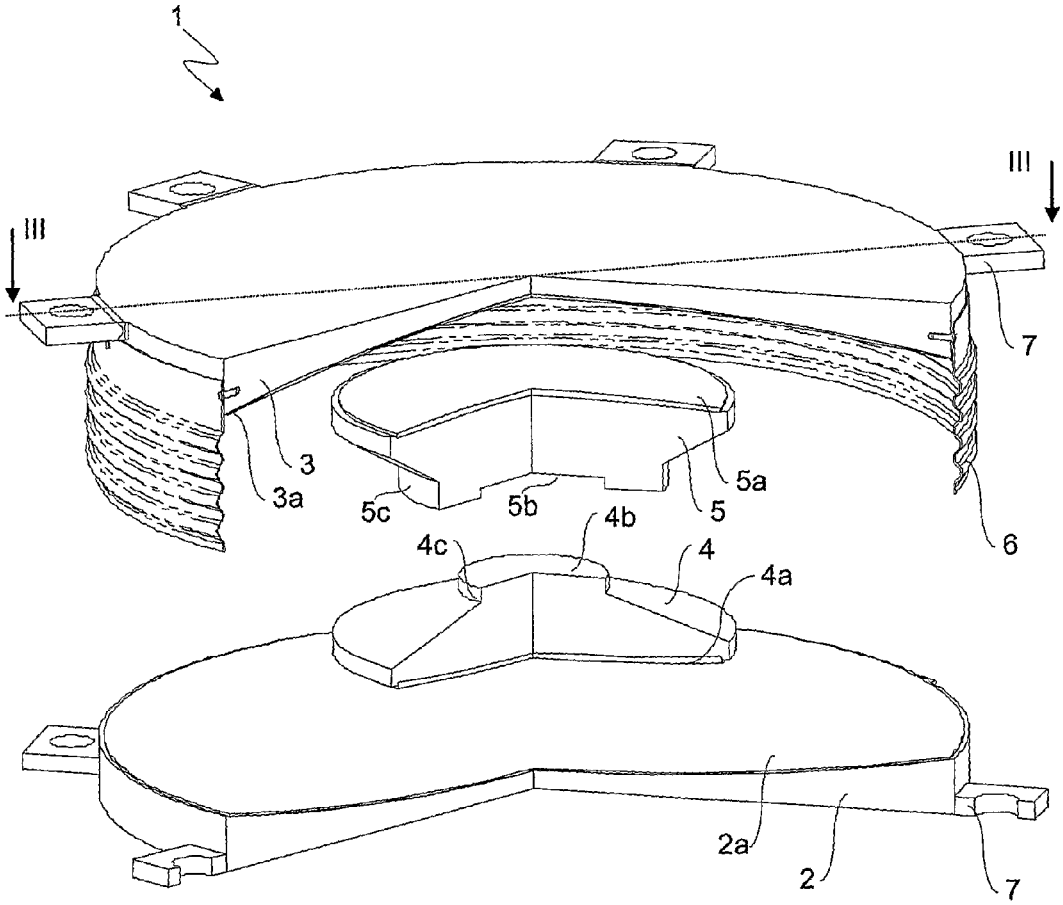
FIG. 1 shows an exploded partially cutaway perspective view of a seismic isolator according to the present invention.

FIG. 1 shows a sliding pendulum seismic isolator 1 according to the present invention, comprising a lower sliding element 2, an upper sliding element 3, a first intermediate element 4 and a second intermediate element 5. The lower sliding element 2 is provided with a concave surface 2*a* facing upwards, whereas the upper sliding element 3 is provided with a concave surface 3*a* facing downwards. Correspondingly, the first and the second intermediate elements 4, 5 are each provided with a convex sliding surface 4*a*, 5*a* suitable to allow the intermediate elements 4, 5 to slide on the concave surfaces 2*a*, 3*a* of the lower and upper sliding elements 2, 3 respectively.

The first intermediate element 4 also has a convex spherical surface 4*b* opposed to the convex sliding surface 4*a* and the second intermediate element 5 has a flat surface 5*b* opposed to the convex sliding surface 5*a*. When the isolator is assembled, the convex spherical surface 4*b* and the flat surface 5*b* are in contact with each other and accomplish a sphere-to-plane support constraint capable of bearing the loads imposed by a superstructure.

Figure 2A:
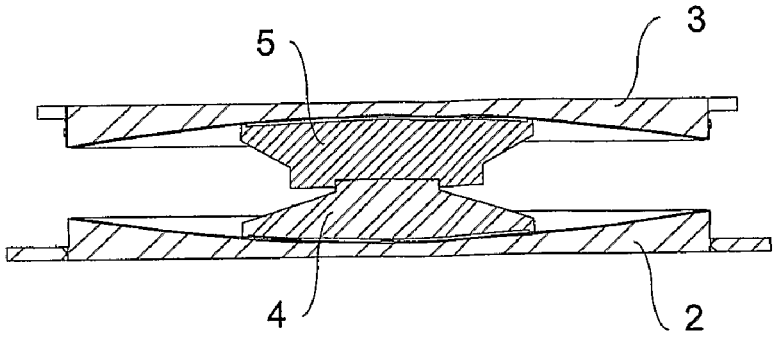
FIGS. 2*a*, 2*b e* 2*c* are cross-sectional views schematically showing the operation of the isolator of FIG. 1.
Figure 2B:
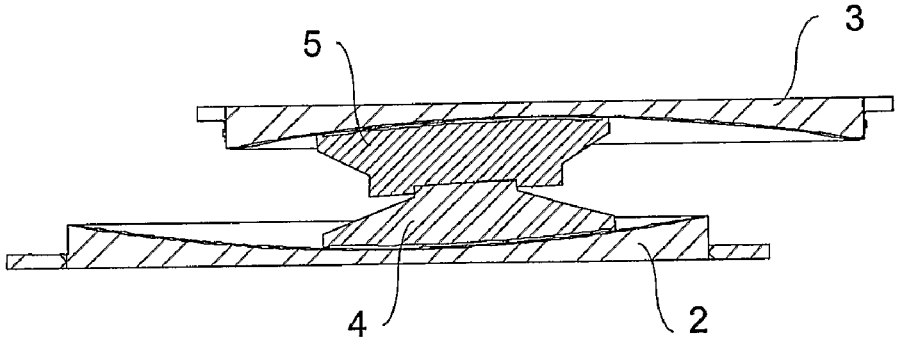
Figure 2C:
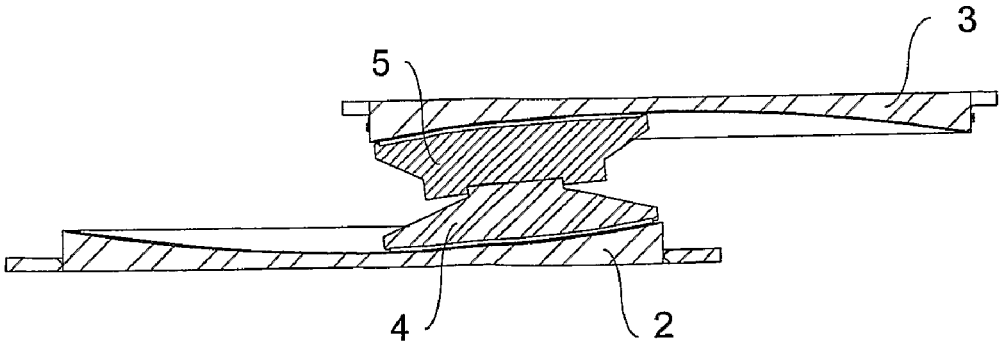

As shown in FIGS. 2*a*, 2*b e* 2*c*, during a seismic event, the lower sliding element 2 and the upper sliding element 3 modify their relative position starting from a substantially symmetrical installation position (FIG. 2*a*) to reach asymmetric operation positions (FIG. 2*b*) up to an end-of-travel position (FIG. 2*c*). As shown in the figures, the intermediate elements 4, 5 translate and rotate as an effect of the curvature of surfaces 2*a*, 3*a*. The coupling between the convex spherical surface 4*b* and the flat surface 5*b* allows the relative rotation between the intermediate elements 4 and 5, which takes place through rolling substantially without sliding, thus allowing the isolator to oppose a minimum parasitic moment against the rotation and, consequently, to have a better dynamic behaviour and to greatly reduce the stresses inside the materials and the adjacent structures.

Figure 3:
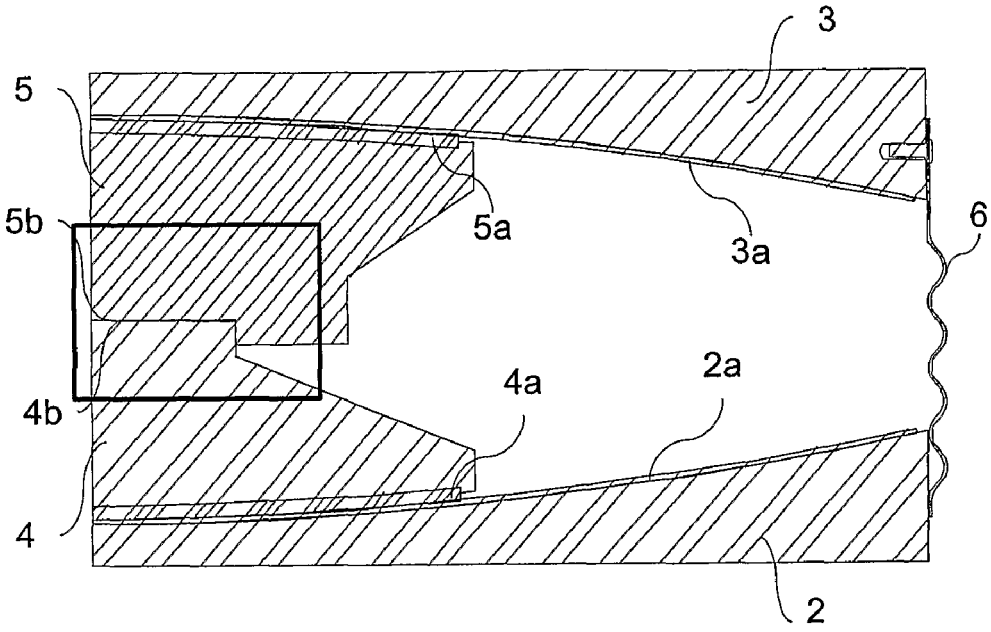
FIG. 3 shows a partial cross-sectional view taken along line III-III of FIG. 1.
Figure 4:
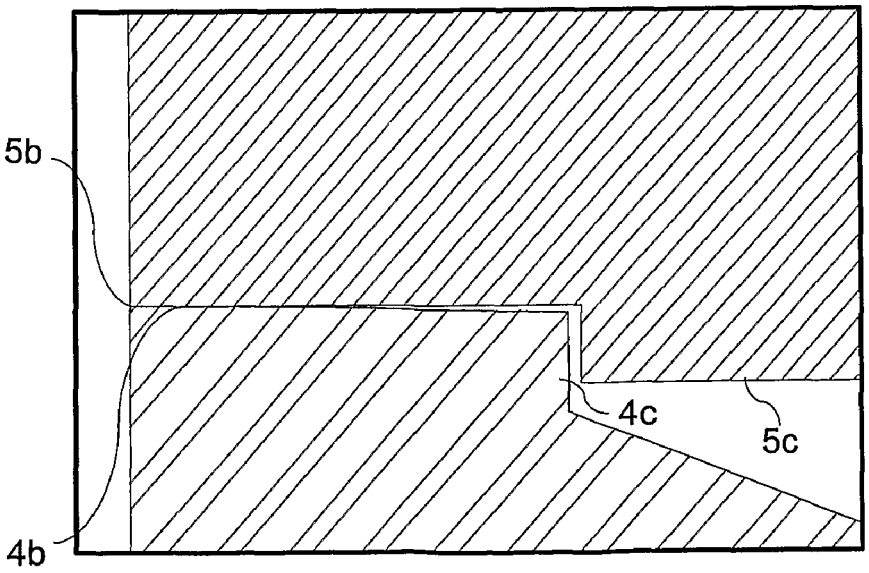
FIG. 4 shows a detail of the cross-sectional view of FIG. 3.

As shown in FIGS. 3 and 4, in order to withstand the horizontal loads occurring during a seismic event, the intermediate elements 4, 5 must be coupled to each other also in the transverse direction. To this purpose, the first intermediate element 4 is provided with a cylindrical protrusion 4*c* on the top of which the convex spherical surface 4*b* is formed and the second intermediate element 5 is provided with a restraint ring 5*c* completely surrounding the flat surface 5*b*. In this way, when the isolator is assembled the convex spherical surface 4*b* of the first intermediate element 4 contacts the flat surface 5*b* of the second intermediate element 5, and the restraint ring 5*c* receives the cylindrical protrusion 4*c* surrounding it completely. The cylindrical protrusion 4*c* of the first intermediate element 4 and the restraint ring 5*c* of the second intermediate element 5 are designed and dimensioned in order to withstand the horizontal loads stressing isolator 1 during a seismic event.

The radial play between the restraint ring 5*c* and the cylindrical protrusion 4*c* is the minimum needed to allow the mounting of the two intermediate elements 4, 5 and a relative rotation of the magnitude of 0.01 radians (0.57 degrees). For example, in an isolator having a radius of curvature of the convex and concave surfaces comprised between 3 meters (9.84 feet) and 3.5 meters (11.48 feet), such a radial play is comprised between 1 and 3 mm.

In order to achieve a good damping effect, the coupling between the lower and upper sliding elements 2, 3 and the respective intermediate elements 4, 5 is preferably accomplished by covering the concave and convex surfaces with controlled friction sliding materials combined so as to minimize the wear, for instance mirror-polished stainless steel plates and plates of pure or, filled PTFE. Alternatively, other suitable materials may be used such as, for example, PE-based materials or polyamidic resins. It is also possible to place lubricant between the sliding surfaces, in order to further improve the dynamic response of the isolator and to provide the desired damping characteristics.

In order to protect the sliding surfaces from dust and atmospheric agents, the isolator according to the present invention preferably further comprises a dust cover element 6 arranged along its periphery and fixed thereto. The dust cover element 6 completely encloses the space comprised between the lower sliding element 2 and the upper sliding element 3 and, in addition, it can extend from the installation position to the end-of-travel position, thus protecting the sliding surfaces in all the operation positions during an earthquake.

The isolator according to the present invention preferably further comprises a plurality of anchoring elements 7, for example metal plates having a central hole, radially arranged at the edges of the lower and upper sliding elements 2, 3. The anchoring elements 7 serve to fix the lower and upper sliding elements 2, 3 to the superstructure and its foundations by using, for instance, screws engaging the threaded holes of anchor bars buried in concrete.

It is clear that the embodiment of the isolator according to the invention above described and illustrated is only an example susceptible of numerous variations. In particular, the concave surfaces 2*a*, 3*a* of the lower and upper sliding elements 2, 3 and the convex surfaces 4*a*, 5*a* of the intermediate elements 4, 5 may be covered with other controlled friction materials well known to those skilled in the art. Moreover, it is possible to manufacture the intermediate elements 4, 5 in or to cover the contact surfaces 4*b*, 5*b* with special materials such as chrome-nickel steel in order to achieve high characteristics of hardness and thus reduce the rolling friction.

The invention claimed is:

1. A sliding pendulum seismic isolator, comprising:

a lower sliding element having a concave surface facing upwards;

an upper sliding element having a concave surface facing downwards;

a first intermediate element;

a second intermediate element, said intermediate elements each having a convex sliding surface allowing the first and second intermediate elements to slide on the concave surfaces of said lower and upper sliding elements respectively, and means to withstand horizontal loads occurring during a seismic event, wherein said first intermediate element has a convex spherical surface opposing said convex sliding surface of said first intermediate element and said second intermediate element has a flat surface opposing said convex sliding surface of said second intermediate element, and said convex spherical surface of said first intermediate element and said flat surface of said second intermediate element are in direct contact with each other and allow a relative rotation substantially without sliding between the intermediate elements.

2. The isolator according to claim 1, wherein the means to withstand the horizontal loads occurring during a seismic event consist of a cylindrical protrusion from a body of the first intermediate element, the convex spherical surface of the first intermediate element being formed at a top of said cylindrical protrusion, and a restraint ring formed at a bottom of the second intermediate element so as to surround the flat surface and to receive the cylindrical protrusion of the first intermediate element.

3. The isolator according to claim 2, wherein radial play between the cylindrical protrusion of the first intermediate element and the restraint ring of the second intermediate element allows a relative rotation between said first and second intermediate elements of 0.01 radians.

4. The isolator according to claim 1, wherein the concave surfaces said lower and upper sliding elements are covered by a plate of a controlled friction material.

5. The isolator according to claim 1, wherein the convex surfaces of said first and second intermediate elements are each covered by a plate of a controlled friction material.

6. The isolator according to claim 4, wherein the plate covering the concave surfaces of the lower and upper sliding elements is made of stainless steel.

7. The isolator according to claim 1, wherein a lubricant is placed between the concave surfaces of said lower and upper sliding elements and the convex surfaces of said first and second intermediate elements.

8. The isolator according to claim 1, wherein the intermediate elements have contact surfaces which are manufactured in chrome-nickel steel.

9. The isolator according to claim 1, further comprising a dust cover element arranged along a periphery of the isolator and fixed to the periphery, said dust cover element completely enclosing a space between the lower and upper sliding elements and being extendable from an installation position to an end-of-travel position of the isolator.

10. The isolator according to claim 1, further comprising a plurality of anchoring elements radially arranged at edges of the lower and upper sliding elements, said anchoring elements allowing the lower and upper sliding elements to be fixed to a superstructure and a foundation of the superstructure respectively.

11. The isolator according to claim 10, wherein the anchoring elements are metal plates provided with a substantially central hole.

12. The isolator according to claim 5, wherein the plate covering the convex surfaces of the first and second intermediate elements is made of PTFE.

* * * * *